US010882091B2

(12) United States Patent
Muschalik

(10) Patent No.: US 10,882,091 B2
(45) Date of Patent: Jan. 5, 2021

(54) EXTRUDER AND TUBE EXTRUDER OR METAL EXTRUSION PRESS

(71) Applicant: SMS group GmbH, Düsseldorf (DE)

(72) Inventor: Uwe Muschalik, Duisburg (DE)

(73) Assignee: SMS group GmbH, Düsseldorf (DE)

( * ) Notice: Subject to any disclaimer, the term of this patent is extended or adjusted under 35 U.S.C. 154(b) by 348 days.

(21) Appl. No.: 16/062,906

(22) PCT Filed: Dec. 14, 2016

(86) PCT No.: PCT/EP2016/081087
§ 371 (c)(1),
(2) Date: Sep. 26, 2018

(87) PCT Pub. No.: WO2017/102896
PCT Pub. Date: Jun. 22, 2017

(65) Prior Publication Data

US 2019/0099792 A1 Apr. 4, 2019

(30) Foreign Application Priority Data

Dec. 17, 2015 (LU) ..... 92917

(51) Int. Cl.
*B21C 23/21* (2006.01)

(52) U.S. Cl.
CPC ..... *B21C 23/211* (2013.01); *B21C 23/217* (2013.01)

(58) Field of Classification Search
CPC ..... B21C 23/21; B21C 23/211; B21C 23/212; B21C 23/217; F15B 1/26; F15B 15/202;
(Continued)

(56) References Cited

U.S. PATENT DOCUMENTS 3,362,208 A * 1/1968 Murphy ..... B21C 23/21 72/260
3,875,781 A * 4/1975 Zilges ..... B21C 23/218 72/257

(Continued)

FOREIGN PATENT DOCUMENTS

| | | | |
|---|---|---|---|
| DE | 10236297 | A1 | 2/2004 |
| JP | S50-47873 | A | 4/1975 |
| JP | H08-90293 | A | 4/1996 |
| JP | H08-207107 | A | 8/1996 |
| JP | H11-22860 | A | 1/1999 |
| JP | 2005-529753 | A | 10/2005 |

(Continued)

OTHER PUBLICATIONS

International Search Report dated Mar. 17, 2017 of corresponding International Application No. PCT/EP2016/081087; 5 pgs.

(Continued)

*Primary Examiner* — Adam J Eiseman
*Assistant Examiner* — Bobby Yeonjin Kim
(74) *Attorney, Agent, or Firm* — Maier & Maier, PLLC

(57) ABSTRACT

An extruder and tube extruder or metal extrusion press that has a press frame, which is composed of a cylinder bar and a counter bar connected to said cylinder bar, in which a movable block receiver holder that bears a block receiver and a movable plunger traverse are provided. A main cylinder or pressing cylinder is arranged in the cylinder bar. The cylinder receiving in its cylinder housing a pressing piston provided with a pressing plunger, and in which an equalization container is arranged in the cylinder housing. The container supplying hydraulic oil to the pressing piston by a slide plate provided on a central linkage. A filling valve that has a lid-like valve cone is formed in the transition from the equalization container to the cylinder housing.

5 Claims, 2 Drawing Sheets

(58) Field of Classification Search
CPC .... F15B 15/02; F15B 15/1471; F15B 11/022; F15B 11/0325
USPC ..... 72/253.1, 453.4–453.6
See application file for complete search history.

(56) References Cited

U.S. PATENT DOCUMENTS

| | | | | |
|---|---|---|---|---|
| 5,595,085 | A | 1/1997 | Chen | |
| 2002/0088601 | A1* | 7/2002 | Hung | B21C 31/00 164/312 |
| 2006/0101886 | A1* | 5/2006 | Claasen | B30B 1/323 72/253.1 |
| 2013/0255249 | A1* | 10/2013 | Maruyama | B60T 8/4077 60/562 |
| 2014/0216122 | A1* | 8/2014 | Yamamoto | B21C 23/215 72/21.3 |

FOREIGN PATENT DOCUMENTS

| | | | |
|---|---|---|---|
| JP | 2005-534501 | A | 11/2005 |
| JP | 2013-039581 | A | 2/2013 |
| JP | 2014-532564 | A | 12/2014 |
| JP | 2014-533202 | A | 12/2014 |
| WO | 2013/064250 | A1 | 5/2013 |
| WO | 2013/064251 | A1 | 5/2013 |

OTHER PUBLICATIONS

Japanese Office Action dated Aug. 28, 2019, in connection with corresponding JP Application No. 2018-531361 (6 pgs., including machine-generated English translation).
Japanese Search Report dated Aug. 20, 2019, in connection with corresponding JP Application No. 2018-531361 (44 pgs., including machine-generated English translation).

* cited by examiner

EXTRUDER AND TUBE EXTRUDER OR METAL EXTRUSION PRESS

FIELD

The invention relates to an extruder and tube extruder or metal extrusion press that has a press frame, which is composed of a cylinder bar and a counter bar connected to the cylinder bar, in which a movable block receiver holder that bears a block receiver and a movable plunger traverse are provided, wherein a main or pressing cylinder is arranged in the cylinder bar, which receives in its cylinder housing a pressing piston provided with a pressing plunger at its front end, supported by the plunger traverse, and in which an equalization container is arranged in the cylinder housing, said container supplying hydraulic oil to the pressing piston by means of a slide plate provided on a central linkage, wherein a filling valve that has a lid-like valve cone is formed in the transition from the equalization container to the cylinder housing, freeing up in its opening function an annular cross section adapted to the large internal diameter in the transition to the cylinder housing.

BACKGROUND

Such a metal extrusion press, in which the counter bar, having the tool, usually a pressure plate, die holder and die, is connected by way of tension rods or pull blades and pressure supports to the cylinder bar, has become known through WO 2013 064 251 A1, establishing the general type of the device. Thanks to the filling valve installed centrally in or on the cylinder housing of the main cylinder, a large annular surface is available through which the oil can flow without major resistance from the equalization container into the pressure space behind the pressing piston and, upon reversal of the pressing piston movement, back into the equalization container, i.e., the oil is moved oscillating back and forth between the equalizing cylinder and the cylinder housing during operation of the metal extrusion press. The pressing piston guided in the cylinder housing of the main cylinder, with the central linkage bearing the slide plate secured in said piston, is thus moved forward or drawn back by the oil supply from the equalization container. The additional quantity of hydraulic oil possibly still required after the feeding of the pressing piston and the block receiver holder for the pressing of the loaded block into an extruded product may be introduced, when the filling valve is closed, from a tank or some other pressurization supply into the pressure space of the cylinder housing behind the pressing piston. The required oscillating volume can be decreased in this case by the interconnection of a tank.

The filling valve of this known metal extrusion press is composed of a filling valve lid, configured as a valve cone, which is arranged on the central linkage above a collar-shaped displacement bushing, and a ring cylinder enclosing the displacement bushing in the pressing direction behind the valve cone, the cylinder piston of said ring cylinder, depending on the piston side subjected to hydraulic oil, moving the displacement bushing and thus the valve cone into either the closed position or the open position. The activation of the cylinder piston requires pressure spaces with corresponding pressurization lines and seals situated in front of and behind it. The ring cylinder installed in the machine unit with its cylinder piston requires a certain fabrication expense up front for the necessary functional elements and is not freely accessible for maintenance work, e.g., the replacement of seals.

SUMMARY

Therefore, the object of the invention is to simplify the functioning and design of the filling valve integrated between the main cylinder and the equalization container in a metal extrusion press of this type, while preserving the well-established principle of the filling valve, especially in regard to the hydraulic and electric control requirements as well as the manufacturing and maintenance expense.

This object is achieved according to the invention in that the central linkage is designed as a sliding guide for the slide plate, said guide being decoupled from the pressing piston, wherein the slide plate at the end away from the pressing piston is fixed to at least two slide rods that run at a radial distance from the central linkage and that are secured to the back end of the pressing piston, on the one hand, and to the slide plate on the other hand, and the central linkage is connected to an actuating drive that is arranged outside of the equalization container and that, when activated, either lifts off the valve cone from its valve seat in the filling valve or retracts it into the valve seat. The central linkage is only still provided with the valve cone screwed on in front of it and no longer serves for the transfer of the pressing piston movements to the slide plate moving at the same time therewith. Instead, this function is taken over by the two slide rods, whereupon the slide plate slides back and forth on the central linkage. The actuating drive, preferably a hydraulic displacement cylinder, in one advantageous embodiment of the invention, can be simply flanged onto the rear wall of the equalization container. The displacement cylinder is unhindered and freely accessible from the outside and also dispenses with the ring cylinder, including displacement bushing for the valve cone, said ring cylinder integrated in the transition from the equalization cylinder to the pressing cylinder, as well as the pressurized oil lines and seals additionally needed for a ring cylinder.

It is proposed according to the invention that the slide rods are secured by screw connections in the pressing piston and on the slide plate. For this purpose, the slide rods are provided with threaded pins at both their ends, so that one threaded pin screws into a threaded bore of the pressing piston, and a nut can be screwed onto the other threaded pin, sticking out from the slide plate. Instead of the screw connections, other comparable types or means of fastening may also be provided. For the guidance and sealing, the slide rods slide in plug bushings, which are installed in the rear wall of the main cylinder, adjoining the equalization container.

One preferred embodiment of the invention provides a bushing configured as a valve seat and installed in sealing manner in a through borehole of the rear wall of the cylinder housing. When the valve cone is lifted off from its valve seat, the adapted large annular cross section of the bushing is free in the transition to the cylinder housing, and the hydraulic oil can constantly move back and forth through said cross section during the operation of the extruder and tube extruder or metal extrusion press with no major resistance.

This free annular cross section is not impaired for the operation of the filling valve if, according to one proposal of the invention, a sealing and guiding unit that is narrower than the bushing is arranged in the bushing, said unit being composed of an outer ring and an inner ring spaced apart from the outer ring, wherein the outer ring engages in an encircling groove of the bushing and the inner ring encloses the central linkage in the manner of a cuff. In this way, the central linkage can be arranged with a two-point bearing and guidance, namely, first in the rear wall of the equalization container, and secondly, in the cuff-shaped inner ring of the sealing and guiding unit in the valve seat bushing.

BRIEF DESCRIPTION OF THE DRAWINGS

Further features and details of the invention will emerge from the claims of the following description of an exemplary embodiment, which is represented in the drawings. Shown therein are:

DETAILED DESCRIPTION

Figure 1:
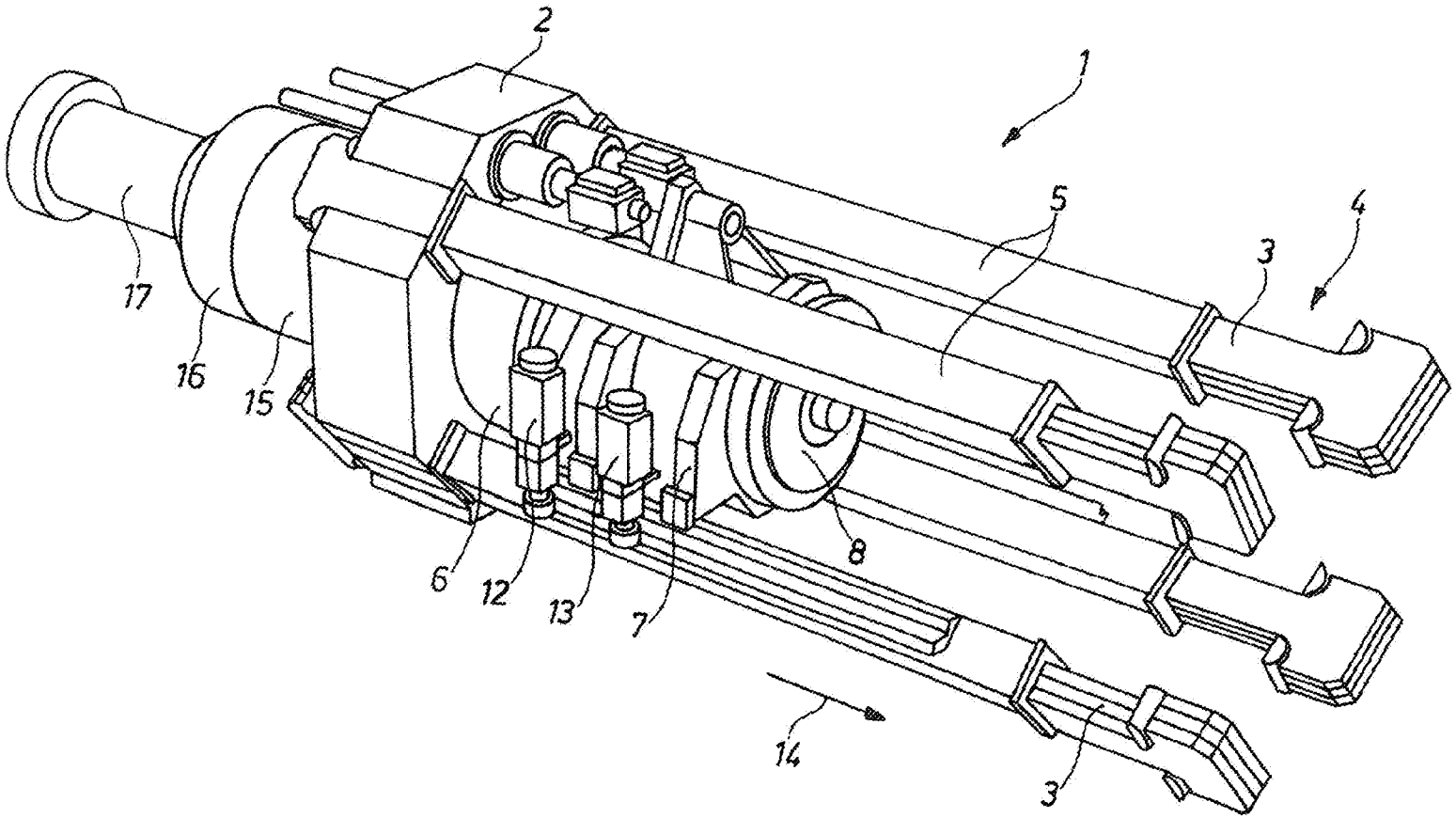
FIG. 1 in perspective view, shown as a detail of an extruder and tube extruder or metal extrusion press, the press frame thereof with plunger traverse and block receiver holder arranged therein.

Essentially only the base frame of an extruder 1 is shown in FIG. 1. The frame is composed of a cylinder bar 2 and a counter bar, which is clamped by way of pull blades 3 and is not represented here, being indicated solely by the reference number 4 at the end of the pull blades 3. Pressure supports 5, which surround the pull blades 3 between the cylinder bar 2 and the counter bar 4, contribute to the force-fit connection of these components. The pressure supports 5, moreover, also serve for the guided receiving of a movable plunger traverse 6 in the base frame and a movable block receiver holder 7. The block receiver holder, comprising a block receiver or container 8, just like the plunger traverse 6 that braces the advancing end of a pressing piston 11 which is guided in the cylinder housing 9 of a main or pressing cylinder with hydrostatic bearing 10 (see FIG. 2), is moved in the pressing direction 14 by means of electric motors 12, 13, especially servo motors, in the exemplary embodiment.

One such electric motor 12, 13 is provided on each long side of the block receiver holder 7 and the plunger traverse 6. In order to transmit or introduce the travel movement, pinions of the electric motors 12, 13 mesh with ratchets. Optionally, instead of having electric motors 12, 13 for the travel and feeding movements of the plunger traverse and the block receiver holder 7, the extruder and tube extruder 1 may be outfitted, e.g., with known hydraulically operated side cylinders and receiver displacement cylinders. For the upsetting and pressing of a block loaded into the block receiver 8, the pressing piston 11 has a pressing plunger 18. Flanged to the back end of the cylinder housing 9 is an equalization container 15 and to its end or rear wall 16 an actuating drive 17, designed as a hydraulic displacement cylinder.

Figure 2:
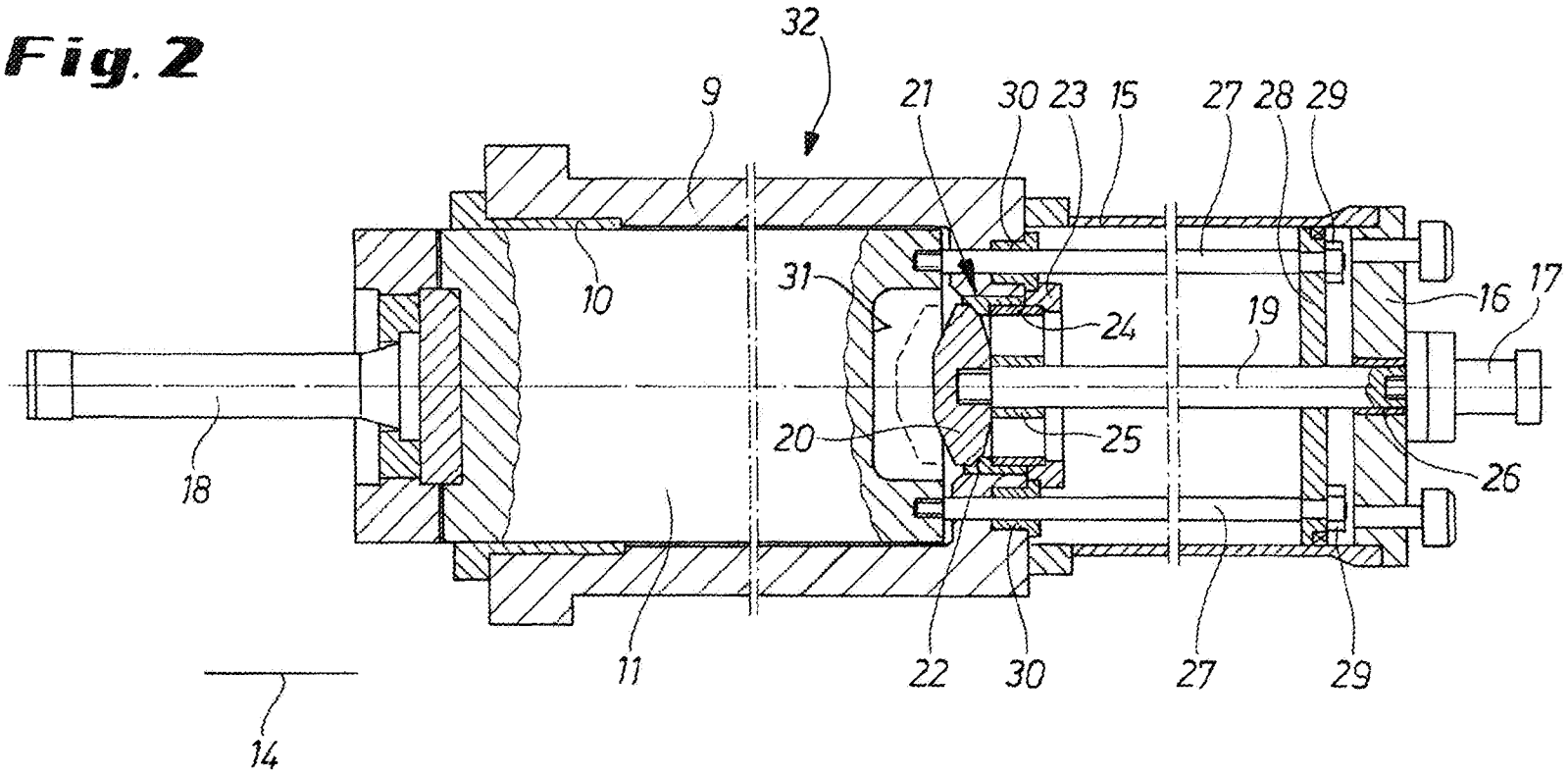
FIG. 2 a partly sectioned view of the back end of an extruder and tube extruder or metal extrusion press, shown without cylinder bar and without plunger traverse and block receiver holder.

As can be seen from FIG. 2, the actuating drive 17 acts on a central linkage 19, on the front end of which is screwed a large-area valve cone 20 of a filling valve 21, which is integrated in the transition from the equalization container 15 to the cylinder housing 9 of the main cylinder 32. The filling valve 21 further comprises a bushing 23, installed in sealing manner in a through borehole of the rear wall of the cylinder housing 9 and configured with a valve seat 22 for the valve cone 20. In the exemplary embodiment, a sealing and guiding unit situated roughly in the middle of the bushing 23 is also provided, comprising an outer ring 24 and an inner ring 25 spaced apart from it, the outer ring 24 engaging with an encircling groove of the bushing 22 and the inner ring 25 surrounding the central linkage 19 in the manner of a cuff. The central linkage 19 is sealed on the outside in the cuff-like inner ring 25 and slides in a bearing bushing 26 in the rear wall 16 of the equalization container 15.

At least two slide rods 27 run in parallel and at a spacing from the central linkage 19, at the back ends of which is arranged a slide plate 28, sliding on the central linkage 19 and secured by means of nuts 29 screwed onto threaded pins sticking out from the slide plate 28. The front ends of the two slide rods 27 are screwed by threaded pins into the pressing piston 11. During displacement movements of the pressing piston 11, the slide rods 27 bearing the slide plate 28 are guided by plug bushings 30 installed in sealing manner in the rear wall of the pressing cylinder 9.

When acted upon by the actuating drive 17, the central linkage 19 is displaced in the pressing direction 14 and thereby lifts the valve cone 20 off from its valve seat 22, shown by solid lines, into the open position, indicated by broken lines, in which the valve cone 20 plunges into a recess 31 of the pressing piston 11. In this open position of the filling valve 21, a large flow cross section is provided by way of the opening cross section of the bushing 23 or the opening cross section between outer and inner rings 24, 25, through which the hydraulic oil from the equalization container 15 may flow with no major resistance into the pressure space of the cylinder housing 9 behind the pressing piston 11—and vice versa. Then, by the feeding movements, i.e., the travel of the plunger traverse 6 and/or the block receiver holder 7 in the pressing direction 14, the hydraulic oil is forced by the slide plate 28, moving along with the pressing piston 11, through the opened filling valve 21 until the pressing piston 11 has taken up its position for the pressing process.

For the subsequent pressing, the filling valve 21 is closed and the pressing force is applied by supplying hydraulic oil from a tank or the equivalent, not shown, into the pressure space behind the pressing piston 11. Since the filling valve 21 is closed, as the pressing piston 11 moves further in the pressing direction 14, an additional quantity of hydraulic oil is drawn by the slide plate 28, pulled further along the slide rods 27, from the equalization container 15 and forced into the tank, not shown.

In order to prepare for a new loading and pressing process, during the return movement of the pressing piston 11 the hydraulic oil flows back into the equalization container 15 by way of the filling valve 21, now again opened by the actuating drive 17. Of course, the drive units (electric motors or displacement cylinders) of the plunger traverse 6 and the block receiver holder 7 are correspondingly activated for the return movement of the pressing piston 11.

The invention claimed is:

1. An extruder that has a press frame, comprising:

a cylinder bar;

a counter bar connected to said cylinder bar;

a movable block receiver holder arranged in the press frame, the movable block receiver holder carrying a block receiver and a movable plunger traverse;

a main cylinder arranged in the cylinder bar, said cylinder receiving in a cylinder housing thereof a pressing piston;

a pressing plunger provided at a front end of the pressing piston, the front end of the pressing piston being supported by the plunger traverse;

an equalization container arranged in the cylinder housing, said container supplying hydraulic oil to the pressing piston by a slide plate provided on a central linkage;

an actuating drive arranged outside of the equalization container;

at least two slide rods running at a radial distance from the central linkage, the slide rods each having a first end being secured to a back end of the pressing piston, and a second end being secured to the slide plate; and a filling valve having a lid-like valve cone is disposed in a transition from the equalization container to the cylinder housing;

a valve seat for the valve cone in the filling valve;

wherein the filling valve, in an opening function thereof, is configured to open an annular cross section adapted to a large internal diameter in the transition to the cylinder housing;

wherein the central linkage is designed as a sliding guide for the slide plate, said guide not being coupled to the pressing piston;

wherein the slide plate at the end away from the pressing piston is fixed to the at least two slide rods; and wherein the central linkage is connected to the actuating drive, which, when activated, is configured to either lift off the valve cone from the valve seat or to retract the valve cone into the valve seat.

2. The extruder as claimed in claim 1, wherein the slide rods are secured by screw connections in the pressing piston and on the slide plate.

3. The extruder as claimed in claim 1, wherein a bushing is configured as the valve seat and installed in sealing manner in a through borehole of the rear wall of the cylinder housing.

4. The extruder as claimed in claim 3, further comprising a sealing and guiding unit arranged in the bushing, said unit composed of an outer ring and an inner ring spaced apart from the outer ring, said unit being narrower than the bushing, wherein the outer ring engages in an encircling groove of the bushing, and the inner ring encloses the central linkage in the manner of a cuff.

5. The extruder as claimed in claim 1, wherein the actuating drive of the central linkage is flanged onto the rear wall of the equalization container.

* * * * *